US006715212B2

(12) United States Patent
Dürr et al.

(10) Patent No.: US 6,715,212 B2
(45) Date of Patent: Apr. 6, 2004

(54) PORTABLE HANDHELD WORK APPARATUS

(75) Inventors: Bernhard Dürr, Stuttgart (DE); Harald Schliemann, Waiblingen (DE); Jörg Schlossarczyk, Winnenden (DE); Manfred Rabis, Schorndorf (DE)

(73) Assignee: Andreas Stihl AG & Co., Waiblingen (DE)

( * ) Notice: Subject to any disclaimer, the term of this patent is extended or adjusted under 35 U.S.C. 154(b) by 64 days.

(21) Appl. No.: 10/162,906

(22) Filed: Jun. 6, 2002

(65) Prior Publication Data

US 2002/0189110 A1 Dec. 19, 2002

(30) Foreign Application Priority Data

Jun. 13, 2001 (DE) ..... 101 28 612

(51) Int. Cl.[7] ..... F01P 1/02
(52) U.S. Cl. ..... 30/383; 30/381
(58) Field of Search ..... 30/381, 382, 383, 30/384, 385, 386; 123/195 C, 198 E

(56) References Cited

U.S. PATENT DOCUMENTS 4,382,333 A * 5/1983 Nagashima et al. ..... 30/381
4,548,169 A * 10/1985 Nagashima ..... 123/195 C
4,936,271 A * 6/1990 Nagashima et al. .... 123/195 C
5,595,153 A * 1/1997 Hoppner et al. ..... 123/198 E

FOREIGN PATENT DOCUMENTS

DE 37 05 338 8/1987
WO WO 97/44582 11/1997

* cited by examiner

*Primary Examiner*—Hwei-Siu Payer
(74) *Attorney, Agent, or Firm*—Walter Ottesen

(57) ABSTRACT

A portable handheld work apparatus such as a motor-driven chain saw includes a housing (6) of a drive unit (2). The following are mounted in the housing (6): an internal combustion engine (3), a carburetor (4) for fuel metering and an air filter (5) as well as a fuel tank (8). The air filter (5) is mounted ahead of the carburetor in the flow direction of the fresh air flow. A largest possible filter action is obtained with a compact configuration in that a housing (10) of the air filter (5) lies at least partially in a space between the carburetor (4) and the fuel tank (8).

11 Claims, 2 Drawing Sheets

PORTABLE HANDHELD WORK APPARATUS

FIELD OF THE INVENTION

The invention relates to a portable handheld work apparatus such as a motor-driven chain saw, brushcutter or the like.

BACKGROUND OF THE INVENTION

An internal combustion engine is provided for driving the work tool in a portable handheld work apparatus. The engine is accommodated within a housing of a drive unit of the work apparatus. A carburetor for metering fuel is also disposed in the housing and the carburetor is connected to a fresh air/fuel mixture inlet of the engine. Furthermore, an air filter is provided which is mounted ahead of the carburetor in the flow direction of the fresh air/fuel mixture and cleans the combustion air inducted by the engine. Finally, a fuel tank is mounted within the housing of the drive unit for supplying fuel to the carburetor and therefore to the engine.

A conventional arrangement of the parts within the housing of the drive unit as known up to now is described in U.S. Pat. No. 4,793,303. Here, the air filter lies above the carburetor which is connected to the cylinder of the engine, that is, the air filter lies on the side of the carburetor facing away from the crankcase of the engine. The air filter is, in this way, mounted next to the outer wall of the housing of the drive unit whereby easy accessibility of the air filter is provided for the exchange of filter material as required.

Arrangements of the air filter directly next to the carburetor are also known. In one such air filter arrangement, as described in U.S. Pat. No. 6,227,162, a round filter is seated on a support formed in the air filter housing with the round filter being within an air filter housing. This support defines an extension of the air channel of the carburetor.

SUMMARY OF THE INVENTION

It is an object of the invention to provide a work apparatus which is improved in such a manner that the largest possible filter effect is obtained with a compact configuration of the drive unit.

The portable handheld work apparatus of the invention includes a motor-driven chain saw and a brushcutter and includes: a drive unit housing; an internal combustion engine mounted in the drive unit housing and having an inlet for conducting an air/fuel mixture into the engine; a carburetor for metering fuel; an air filter mounted in the housing upstream of the carburetor for receiving a flow of air; the carburetor being connected to the inlet of the engine and metering fuel to form the air/fuel mixture; a fuel tank mounted in the housing; the carburetor and the fuel tank conjointly defining a space therebetween; and, the air filter having an air filter housing disposed in the space so as to lie partially below the carburetor.

According to a feature of the invention, a housing of the air filter is provided which lies partially in a space between the carburetor and the fuel tank. The fuel tank is arranged in the drive unit at a spacing to the carburetor. The carburetor lies next to the cylinder head of the engine which is especially advantageous when utilizing four-stroke internal combustion engines. With the arrangement of the air filter below the carburetor (that is, between the carburetor and the fuel tank), a very compact configuration of the drive unit can be achieved whereby the manipulability of the work apparatus is improved. If a larger air filter is required, then the housing of the air filter can expand into a region next to the carburetor.

With the arrangement of vibration-dampening means, the housing of the air filter is advantageously arranged as an isolated vibration system within the housing of the drive unit. It is practical to hold the housing of the air filter on an inner wall of the housing of the drive unit with the interposition of the vibration damping means in the form of an anti-vibration element. This inner wall separates the engine from the air filter. The inner wall then partitions the inner space of the drive unit housing into two parts whereby the engine is separated from the air filter. The housing of the air filter is supported on the inner wall via the anti-vibration element.

The housing of the air filter is partitioned into a contaminant space and a clean space by a filter element mounted in the air filter. The clean space of the housing is provided in the space region lying at the elevation of the carburetor. The clean space can extend into the region disposed between the carburetor and the fuel tank. The filter element can be configured essentially flat or planar and is advantageously exchangeable from the end face of the drive unit. For this purpose, an opening is provided in the housing of the drive unit at the elevation of the air filter lying next to the housing wall. An arrangement of the air filter in a drawer-like component which can be pulled out of the drive unit is also practical.

BRIEF DESCRIPTION OF THE DRAWINGS

The invention will now be described with reference to the drawings wherein.

DESCRIPTION OF THE PREFERRED INVENTION

Figure 1:
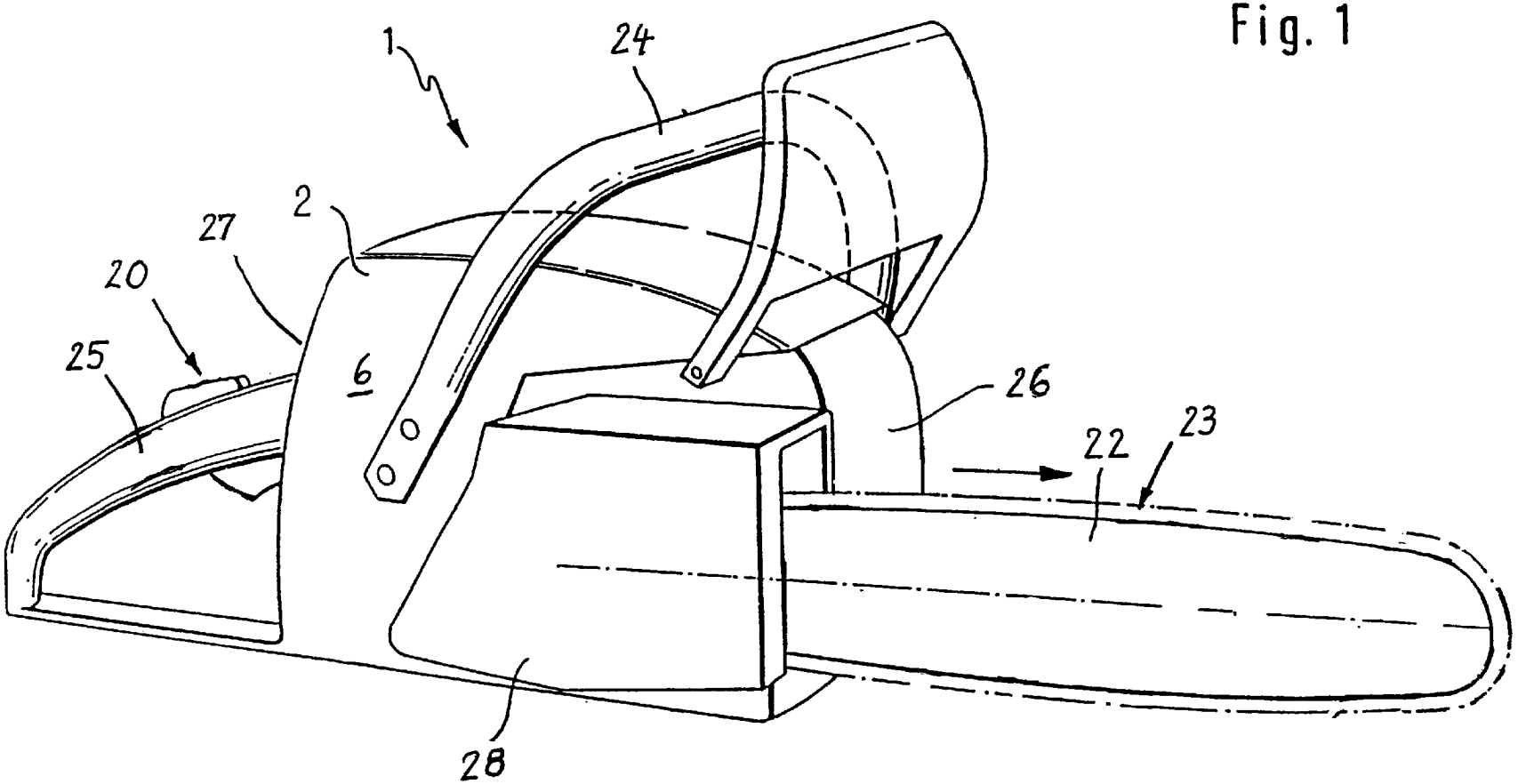
FIG. 1 is a perspective view of a motor-driven chain saw.

The motor-driven chain saw 1 shown in FIG. 1 includes essentially a drive unit 2 for a saw chain 23 which is guided to move along a guide bar 22. A carrying handle 24 is fixed to the housing 6 of the drive unit 2. A rearward handle 25 is mounted on the drive unit 2 at the rearward end face 27 facing away from the guide bar 22. The handle 25 also accommodates operator-controlled elements 20 of the chain saw 1. An internal combustion engine 3 is mounted in the interior of the drive unit 2 and this engine is a four-stroke engine in the embodiment shown.

Figure 2:
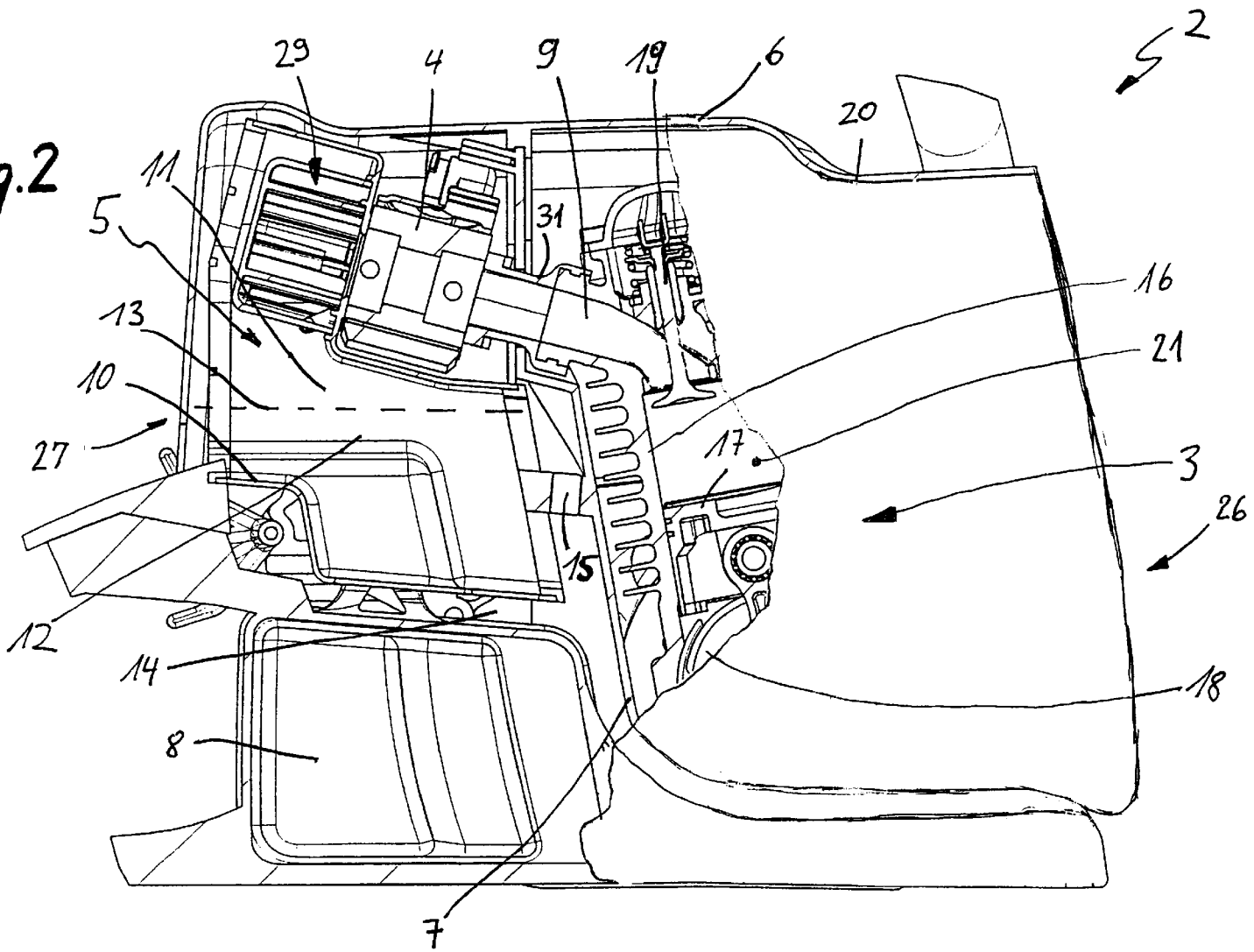
FIG. 2 is a detail section through the drive unit of a motor-driven chain saw.

The combustion air, which is needed for operation, is supplied to a carburetor 4 (FIG. 2) via an air filter 5. The carburetor adds fuel to the combustion air and the air/fuel mixture, which is so formed, is supplied to the combustion chamber 21 of the engine. The fuel is taken from a fuel tank 8 which is mounted in the drive unit 2 on the base of the housing 6. The fuel tank 8 and the air filter 5 lie in the housing 6 of the drive unit 2 next to the rearward end face 27 of the drive unit 2 facing away from the work tool.

The interior space of the housing 6 of the drive unit 2 is partitioned by an inner wall 7. The internal combustion engine 3 is accommodated in the forward part of the drive unit 2 which faces toward the guide bar 22. The engine 3 is a single-cylinder four-stroke engine having a cylinder 16 in which a piston 17 reciprocates in a manner known per se and transmits its work power with a crank drive to the saw chain 23 via a sprocket lying below a sprocket wheel cover 28 (FIG. 1). The crankcase 18 of the engine 3 is accommodated in the housing 6 in such a manner that the engine 3 lies with its cylinder 16 at an angle in the direction of the rearward end face 27 of the drive unit 2. A fresh air/fuel mixture inlet 9 is configured in the cylinder head of the engine. The fresh air/fuel mixture supply and also an exhaust-gas outlet (not shown) are controlled by a valve drive 19 having gas-exchange valves. The exhaust gas is discharged to the forward end face 26 via an exhaust-gas muffler.

The carburetor 4 for fuel metering is connected to the fresh air/fuel mixture inlet 9 of the engine and the fuel tank 8 is provided at the elevation of the crankcase 18 next to the base of the housing 6. According to a feature of the invention, an air filter 5 is provided having a housing 10 fitted into an intermediate space between the carburetor 4 and the fuel tank 8. In this way, a compact configuration is achieved. The essential part of the air filter housing 10 lies between the elevation of the carburetor 4 and the elevation of the fuel tank 8. The carburetor 4, the fuel filter 5 and the fuel tank 8 lie essentially in a common plane perpendicular to the longitudinal direction of the guide bar 22 of the chain saw 1.

The housing 10 of the air filter 5 extends in the elevation direction of the drive unit 2 corresponding to the engine cylinder axis into a region next to the carburetor 4 and, in this way, acquires a characteristic angular shape. The carburetor 4 is fitted into the interior space region surrounded by the air filter housing 10. In this way, the air filter 5 can be pushed into the housing 6 from the rearward end face 27 when assembling the drive unit 2 and, if required, with the carburetor 4 already mounted.

The region of the air filter 5, which lies next to the carburetor, is the clean space region 11 which is separated from the contaminant space 12 by a filter element 13 in the interior of the air filter 5. The filter element 13 can be configured to be planar. Access is provided in the rearward end face 27 of the housing 6 for the assembly and disassembly of the air filter 5 or of the filter element 13. The filter element 13 can also be configured as a pull-out drawer component.

A baffle pot 29 is mounted in the clean space 11 concentrically to a longitudinal axis of the carburetor 4. The baffle pot 29 is preferably fastened to the base of the filter housing 10 lying on the carburetor. The baffle pot 29 prevents the exit of the fuel droplets from the intake tank in order to keep the filter element dry.

The air filter 5 is advantageously mounted within the housing 6 of the drive unit 2 so as to be damped with respect to vibration. For this purpose, the carburetor 4 is connected to the fresh air/fuel mixture inlet 9 via an elastic intake channel section 31 and the housing 10 of the filter 5 is supported on the inner wall 7 of the housing 6 by an anti-vibration element 15. The anti-vibration element 15 lies approximately at the elevation of the cylinder 16 and holds the housing 10 of the air filter 5 at a spacing with respect to the interior wall 7 whereby an intake space for the fresh air is formed. The fuel tank 8 and the air filter 5 are mounted so as to define an intermediate gap 14 through which air can flow to the filter at a high air throughput.

It is understood that the foregoing description is that of the preferred embodiments of the invention and that various changes and modifications may be made thereto without departing from the spirit and scope of the invention as defined in the appended claims.

What is claimed is:

1. A portable handheld work apparatus comprising:

a drive unit housing;

an internal combustion engine mounted in said drive unit housing and having an inlet for conducting an air/fuel mixture into said engine;

a carburetor for metering fuel;

an air filter mounted in said housing upstream of said carburetor for receiving a flow of air;

said carburetor being connected to said inlet of said engine and metering fuel to form said air/fuel mixture;

a fuel tank mounted in said housing;

said carburetor and said fuel tank conjointly defining a space therebetween; and, said air filter having an air filter housing disposed in said space so as to lie partially below said carburetor.

2. The portable handheld work apparatus of claim 1, wherein said air filter housing extends into a region next to said carburetor.

3. The portable handheld work apparatus of claim 1, wherein said carburetor, said air filter and said fuel tank all lie approximately in one plane.

4. The portable handheld work apparatus of claim 1, wherein a portion of said air filter housing lies at the elevation of said carburetor; said air filter includes a filter element partitioning said air filter housing into a clean space and a contaminant space; and, said clean space is in said portion of said air filter housing and extends into said space between said carburetor and said fuel tank.

5. The portable handheld work apparatus of claim 4, wherein said filter element is configured to be essentially planar.

6. The portable handheld work apparatus of claim 1, further comprising vibration damping means for mounting said air filter in said drive unit housing.

7. The portable handheld work apparatus of claim 6, wherein said drive unit housing includes an inner wall for separating said internal combustion engine from said air filter; and, said air filter is supported on said inner wall with said vibration damping means disposed therebetween.

8. The portable handheld work apparatus of claim 7, wherein said vibration damping means is mounted adjacent a cylinder of said internal combustion engine.

9. The portable handheld work apparatus of claim 1, wherein said air filter and said fuel tank conjointly define a gap for permitting said flow of air to flow into said air filter.

10. The portable handheld work apparatus of claim 1, wherein said internal combustion engine is a four-stroke engine.

11. The portable handheld work apparatus of claim 1, wherein the work apparatus is selected from a group consisting of a motor-driven chain saw and a brushcutter.

* * * * *